US009076624B2

(12) United States Patent
Heuermann

(10) Patent No.: US 9,076,624 B2
(45) Date of Patent: Jul. 7, 2015

(54) GENERATING MICROWAVE RADIATION

(71) Applicant: Oliver Heuermann, Adelsdorf (DE)

(72) Inventor: Oliver Heuermann, Adelsdorf (DE)

(73) Assignee: Siemens Aktiengsellschaft, München (DE)

( * ) Notice: Subject to any disclaimer, the term of this patent is extended or adjusted under 35 U.S.C. 154(b) by 238 days.

(21) Appl. No.: 13/892,204

(22) Filed: May 10, 2013

(65) Prior Publication Data

US 2013/0300287 A1 Nov. 14, 2013

(30) Foreign Application Priority Data

May 11, 2012 (DE) ..... 10 2012 207 930

(51) Int. Cl.
*H01J 25/50* (2006.01)
*H01J 23/34* (2006.01)

(52) U.S. Cl.
CPC ..... *H01J 23/34* (2013.01)

(58) Field of Classification Search
CPC ..... H01J 25/587; H01J 23/05; H01J 23/15; H01J 25/50; H01J 23/10
USPC ..... 315/39.51; 307/107, 108, 110
See application file for complete search history.

(56) References Cited

U.S. PATENT DOCUMENTS 3,084,284 A 4/1963 Schultz, Sr. et al.
3,691,377 A 9/1972 Matsui et al.
5,495,209 A * 2/1996 Gerstenberg ..... 332/108
7,755,217 B2 7/2010 Heuermann
8,488,336 B2 * 7/2013 Lacarnoy ..... 363/17
2009/0033228 A1 2/2009 Kobayashi et al.
2012/0193992 A1 8/2012 Heuermann
2014/0320105 A1 * 10/2014 Liu et al. ..... 323/311

FOREIGN PATENT DOCUMENTS

DE 102006060417 A1 7/2008
DE 102011003526 A1 8/2012

OTHER PUBLICATIONS

German Office Action dated Jan. 21, 2013 for corresponding German Patent Application No. DE 10 2012 207 930.0 with English translation.
C. Karzmark, "Advances in Linear Accelerator Design for Radiotherapy," Med. Phys., vol. 11, pp. 105-128, 1984.
Y. Ding, "The State and Art of Cathode Technology in High Power Klystron," Vaccuum Electron Source Conference, IEEE Proceedings of IVESC, pp. 141-143, 2004.
FerroTec Power Supplies Feature Overview, URL:http://web.archive.org/web/20120203212648/http://vacuum.ferrotec.com/products/vacuumCoating/powerSupply, Feb. 3, 2012.

* cited by examiner

*Primary Examiner* — Quan Tra
(74) *Attorney, Agent, or Firm* — Lempia Summerfield Katz LLC

(57) ABSTRACT

A method for operating a device having an anode and a cathode for generating microwave radiation with an accelerating voltage is provided. A chronological sequence of the accelerating voltage is provided by a series of voltage pulses. A first voltage pulse with an operating amplitude is applied between the anode and the cathode in order to determine whether an electric flashover occurs during the applied first voltage pulse. A second voltage pulse is applied following the first voltage pulse with a deionization amplitude that is smaller than the operating amplitude when the electric flashover occurs during the applied first voltage pulse.

20 Claims, 2 Drawing Sheets

GENERATING MICROWAVE RADIATION

This application claims the benefit of DE 10 2012 207 930.0, filed on May 11, 2012, which is hereby incorporated by reference.

BACKGROUND

The present embodiments relate to operating a device with an anode and a cathode for generating microwave radiation.

A device for generating microwave radiation of electromagnetic fields with a frequency in the range of approximately 0.3 to 300 GHz may, for example, be a magnetron or a klystron. Such devices generate electromagnetic fields with a very high output in the kW and MW range. Such fields are used, for example, in linear electron accelerators for the acceleration of an electron beam. The electron beam may be used to generate high power X-radiation. Such devices for generating microwave radiation are used in this respect, for example, in medical therapy equipment such as in a radiotherapy device. Such devices may be used in industrial devices for fluoroscopy or treatment (e.g., in devices for non-destructive materials testing) for container screening or for food irradiation.

A method for operating a magnetron with an accelerating voltage, the chronological sequence of which is provided by a series of voltage pulses, is, for example, known from DE 10 2006 060 417 A1.

SUMMARY AND DESCRIPTION

The scope of the present invention is defined solely by the appended claims and is not affected to any degree by the statements within this summary.

The present embodiments may obviate one or more of the drawbacks or limitations in the related art. For example, the known method may be improved.

An amplitude of the accelerating voltage is reduced to a value greater than zero after an electric flashover between an anode and a cathode, in cavity resonators or at an outlet of a device for generating microwave radiation.

The space between the anode and the cathode of the device may be ionized. This may lead to a reduction of an electrical resistance between the anode and the cathode. As a result, each voltage pulse of the accelerating voltage applied between the anode and the cathode may result in an aforementioned electric flashover and thus in an electric arc between the anode and the cathode of the device.

Additional electric flashovers may be avoided by deionization of the space between the anode and the cathode of the device. For example, the accelerating voltage may be switched off between the anode and the cathode of the device during a deionization period, and in so doing, the aforementioned voltage pulses may be stopped until sufficient deionization of the space is provided.

In the case of an ionized space between the anode and the cathode of the device and consequently of reduced electrical resistance, an accelerating voltage applied between the anode and the cathode only results in a current flow and consequently in an electric flashover if the amplitude of the voltage pulses is sufficiently high.

Based on this consideration, the accelerating voltage is not switched off in the case of electric flashovers. Instead, the operating amplitude of the voltage pulses is only reduced. In this way, the device for generating microwave radiation may still be ready for use, even if with reduced output power. In addition, the anode and the cathode are not cooled down by further operation and thus accelerate deionization on account of chemical gas particle diminution by van der Waal forces.

In one embodiment, a method for operating a device with an anode and a cathode for generating microwave radiation with an accelerating voltage is provided. The chronological sequence of the accelerating voltage is provided by a series of voltage pulses. The method includes applying a first voltage pulse with an operating amplitude between the anode and the cathode, and determining whether during the applied first voltage pulse, an electric flashover occurs. The method also includes applying a second voltage pulse following the first voltage pulse with a deionization amplitude that is smaller than the operating amplitude when the electric flashover occurs during the applied first voltage pulse in the device.

With the method, a device for generating microwave radiation may also continue to be operated with reduced output during the deionization of the space between the anode and the cathode, which increases the operating life of the device. In addition, deionization is accelerated so that the full output of the device is available again sooner.

In one embodiment, the method includes waiting a deionization period before the application of the second voltage pulse when the electric flashover occurs. The accelerating voltage may therefore also be switched off for the duration of a deionization period, although a comparatively short deionization period may be selected.

In one embodiment, the method includes applying at least one further first voltage pulse with the operating amplitude before the application of the second voltage pulse, and counting of the applied first voltage pulse between the anode and the cathode, in which the electric flashover occurs. The method also includes applying the second voltage pulse when the number of first voltage pulses in which the flashover occurs exceeds a predetermined number. This is based on the consideration that a single electric flashover may not result in such high ionization of the space between the anode and the cathode of the device that all further voltage pulses result in an electric flashover and thus in electric arcs. As a criterion for excessive ionization, the deionization of the space may only be initiated by the reduction of the amplitude of the voltage pulses after the occurrence of a certain number of electric flashovers.

In one embodiment, the method includes resetting the number of first voltage pulses in which the electric flashover occurs when, after a first voltage pulse in which the electric flashover has occurred, a predetermined flashover-free period elapses. The time between two electric flashovers may also be an indication of the ionization of the space between the anode and the cathode of the device. If this flashover-free time is sufficiently great, then it may be assumed that the ionization of the space is not yet sufficiently great to cause an electric flashover in the case of every voltage pulse of the accelerating voltage.

In one embodiment, the method includes determining whether, during the applied second voltage pulse, an electric flashover occurs. The method also includes reducing the deionization amplitude when the electric flashover occurs during the applied second voltage pulse, and applying the second voltage pulse with the reduced deionization amplitude between the anode and the cathode.

In one embodiment, the specified method includes repeating the reduction of the deionization amplitude and application of the second voltage pulse with the reduced deionization amplitude between the anode and the cathode when the electric flashover occurs during the applied second voltage pulse with the reduced deionization amplitude between. Using the specified method, the necessary reduced output of the device for generating microwave radiation for deionization may gradually be found so that the output is not reduced too much or switched off unnecessarily.

The method includes determining a fault when a value of the reduced deionization amplitude falls below a predetermined value. In this way, devices that are already faulty and may no longer be operated free of flashovers may be rejected.

In one embodiment, the accelerating voltage is generated by a multilevel converter connected between the anode and the cathode. The multilevel converter has a number of energy storage devices that are cascadable and may be connected in series between the anode and the cathode. A multilevel converter may be an electric circuit that may generate a unipolar output voltage with variable voltage levels from direct voltage as the input voltage using the energy storage devices. Such multilevel converters may, for example, be constructed of cascaded H-bridges or as Marx generators.

In one embodiment, the method includes switching a first number of energy storage devices in series for the generation of the first voltage pulse, and switching a second number of energy storage devices in series for the generation of the second voltage pulse. The number of the first energy storage devices selected is greater than the number of the second energy storage devices. With the method, in the generation of the accelerating voltage, individual energy storage devices are switched off. The voltage pulses may be generated in a technically simple manner using the deionization amplitude.

In one embodiment, an appliance that is set up to perform the method described above is provided.

For example, the appliance has a storage device and a processor. The method in the form of a computer program is stored in the storage device, and the processor, for the performance of the method, is provided when the instructions of the computer program are loaded into the processor from the storage device.

In one embodiment, an arrangement that includes a device for generating microwave radiation with an anode and a cathode and the specified appliance for the generation of an accelerating voltage between the anode and the cathode is provided.

In one embodiment, the arrangement includes a Marx modulator as a multilevel converter.

In another embodiment, a medical therapy device for radiotherapy or an industrial device for fluoroscopy or irradiation is provided. The device includes an arrangement for generating microwave radiation.

DETAILED DESCRIPTION

Figure 1:
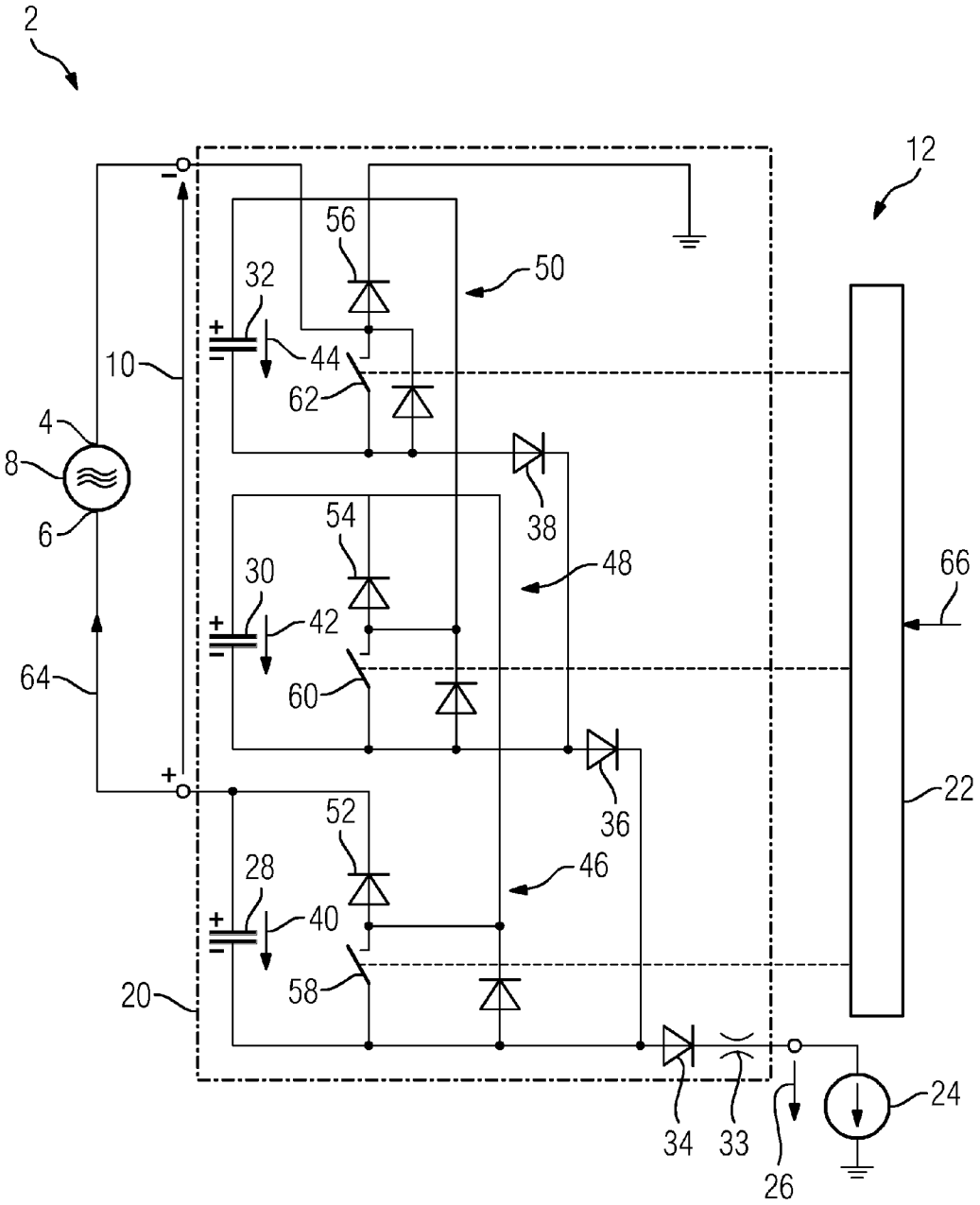
FIG. 1 is a circuit diagram of one embodiment of an arrangement with a device having an anode and a cathode and an appliance operating the device.

In the figures, the same technical elements are given the same reference characters and are only described once.

FIG. 1 shows a circuit diagram of an arrangement 2 with a device 8 having a cathode 4 and an anode 6 for generating microwave radiation and an appliance 12 operating the device 8 with an accelerating voltage 10.

The device 8 may be an electron tube for microwave generation or amplification and may be used, for example, in the form of a magnetron. Any desired velocity-modulated tube, however, may be selected as the device 8, the operating principle of which is based on the transit time of electrons. Thus, both crossed field tubes such as amplitrons and magnetrons as well as linear beam tubes such as klystrons, traveling wave tubes, carcinotrons and gyrotrons may also be selected as the device 8.

The accelerating voltage 10 is composed of a plurality of voltage pulses 14, 16, 18, as described below in more detail on the basis of FIG. 2. The appliance 12 outputting the accelerating voltage 10 may therefore include any voltage source outputting voltage pulses 14, 16, 18 that may output voltage pulses with a variable amplitude. In one embodiment, the appliance 12 also includes a multilevel generator 20 that is controlled by a control system 22. The multilevel generator 20 is exemplified as a three-stage Marx generator for this purpose. However, any multilevel generators 20 such as, for example, multilevel H-bridge generators, flying capacitor multilevel generators or diode-clamped multilevel generators may be used. A unipolar negative voltage is generated with the multilevel generator 20.

The plotted three-stage Marx generator 20 converts a direct voltage 26 output by a direct voltage source 24 into the accelerating voltage 10. The direct voltage source 24 outputting the direct voltage 26 may be configured in any manner. Thus, the direct voltage source 24 may, for example, be a rectifier that is connected to a standard voltage network with two or three phases, an electric generator or a battery. In one embodiment, the direct voltage source 24 is shown as an ideal direct voltage source for the sake of simplicity.

In one embodiment, the three-stage Marx generator 2 has buffer storage devices 28 to 32 that temporarily store the electrical energy from the direct voltage source 24. The buffer storage devices 28 to 32 viewed in the drawing plane are enumerated from bottom to top as first buffer storage device 28 to third buffer storage device 32. All the energy storage systems may be used as buffer storage devices 28 to 32, absorb and store the electrical energy and emit the electrical energy again on request. Such energy storage systems are, for example, capacitors or accumulators. In the figures, capacitors are shown as, for example, buffer storage devices 28 to 32.

The buffer storage devices 28 to 32 may be connected in parallel to the direct voltage source 24 via charging inductance 33 and via charge diodes 34 to 38. The individual cell voltages 40 to 44 of the buffer storage devices 28 to 32 may be increased to the value of the direct voltage 28 and the buffer storage devices 28 to 32 charged in this way.

Each buffer storage device 28 to 32 is interconnected in a storage cell 46 to 50, in which a free-wheeling diode 52 to 56 and a discharge switch 58 to 62 are each interconnected. The individual storage cells 46 to 50 are connected in series to the magnetron 8. The individual storage cells 46 to 50 may increase the level of the accelerating voltage 10 on the magnetron 8 individually and independently of each other. For this purpose, the discharge switches 58 to 62 of the corresponding storage cell 46 to 50, which are intended to contribute to the level of the accelerating voltage 10, are closed. If the discharge switch 58 to 62 of a storage cell 46 to 50 remains open, a current 64 flows past through the magnetron 8 via the corresponding free-wheeling diode 52 to 56 on the buffer storage device 40 to 44 of the corresponding storage cell 46 to 50 so that this storage cell 46 to 50 does not then contribute to the accelerating voltage 10. In other words, the level of the accelerating voltage 10 may be reduced or increased by a cell voltage 40 to 44 by controlled opening and closing of the individual discharge switches 58 to 62.

The discharge switches 58 to 62 are controlled via the control appliance 22. This may, for example, receive a quantized reference signal 66, the form of which is to be reproduced by the accelerating voltage 42. The quantized reference signal 66 may be generated in any way desired.

Based on the quantized reference signal 66, the control appliance 22 generates a control signal 68 to 72 for each discharge switch 58 to 62 in order to reproduce the form of the quantized reference signal 66 in the accelerating voltage 10 with the individual storage cells 46 to 50.

Figure 2:
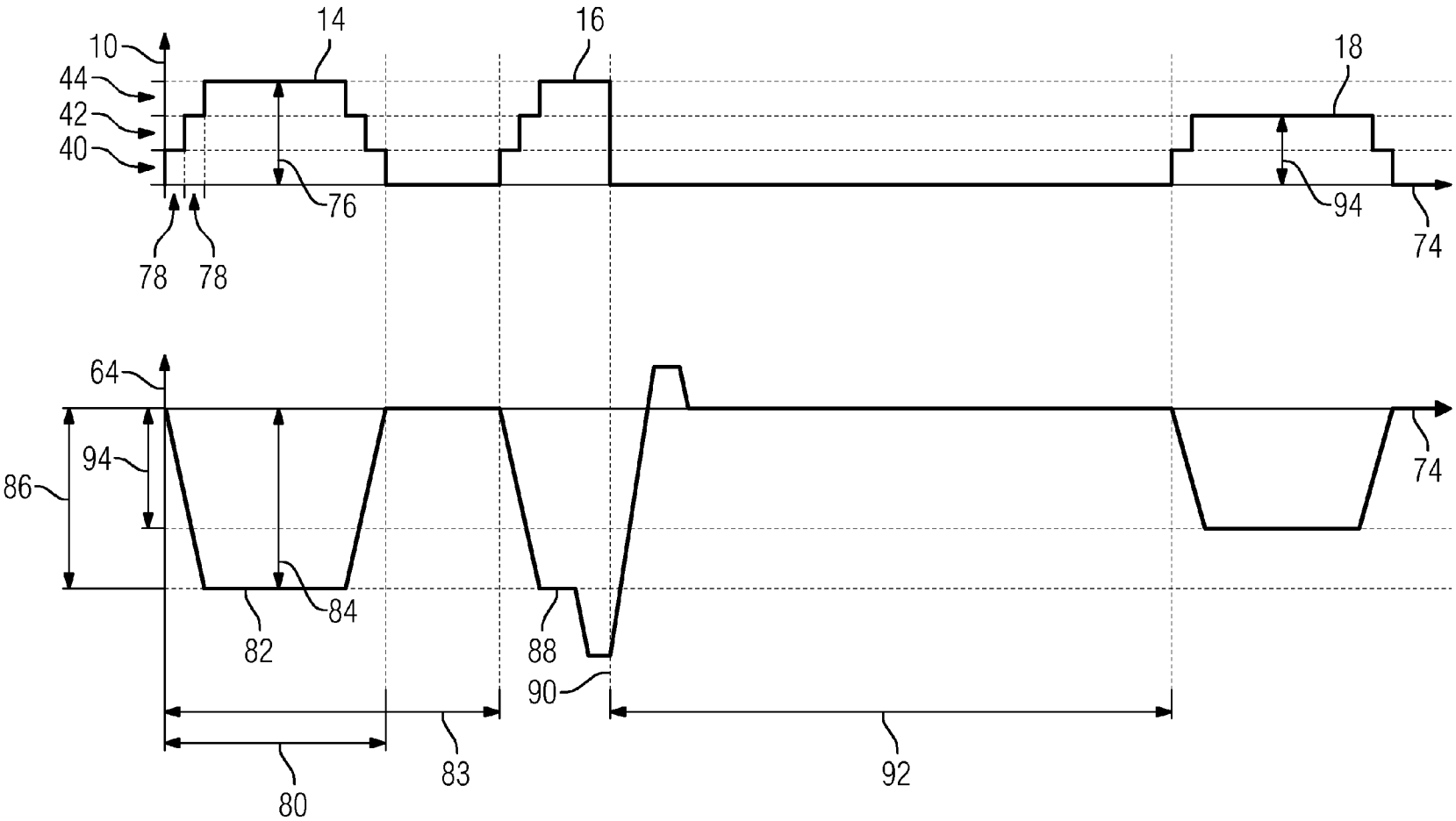
FIG. 2 illustrates example chronological sequences of the accelerating voltage and the device current from the arrangement of FIG. 1.

FIG. 2 shows the sequences of the accelerating voltage 10 and of the magnetron current 64 from the arrangement 2 of FIG. 1 over time 74.

During normal operation of the magnetron 8, the accelerating voltage 10, which has an operating amplitude 76, is formed from first voltage pulses 14. The first voltage pulses 14 may be formed such that the resulting voltage on the magnetron 8 (not shown in FIG. 1) has a restricted voltage rise. For this purpose, the control appliance 22 switches on the individual storage cells 46 to 50 consecutively at staggered intervals 78. In one embodiment, these intervals are selected to be the same. However, the intervals may also vary according to the requirements of the load. At the end of the first voltage pulses 14, the control appliance 22 switches off the individual storage cells 46 to 50 again at staggered intervals. This may not be provided. The individual storage cells 46 to 50 may alternatively be switched off jointly at the end of the first voltage pulses as well.

The individual first voltage pulses 14 bring about first current pulses 82 in a manner known to the person skilled in the art during pulse duration 80 by the magnetron 8. These first current pulses 82 have a current amplitude 84 that does not exceed a first current threshold 86 in error-free operation of the magnetron 8.

After a time 83, a further voltage pulse 16 is initially generated in the same way as the first voltage pulse 14 by the control appliance 22. However, during the voltage pulse 16, it may be assumed that an electric flashover occurs between the anode 4 and the cathode 6 of the magnetron 8. This electric flashover is described as a tube arcing and results in an electric arc between the anode 4 and the cathode 6 of the magnetron 8. The electric flashover may be measured by the fact that a corresponding current pulse 88 of the current 64 through the magnetron 8 exceeds the first current threshold 86. As a reaction to this exceeding of the first current threshold 86, the control appliance may switch off all the storage cells 46 to 50 together at a protection switching time 90. As a result, the current 88 through the magnetron 8 decays to zero in a way known to the person skilled in the art.

With the application of additional voltage pulses as accelerating voltage 10 to the magnetron 8, from the protection switching time 90, the control appliance 22 may wait for a deionization period 92 in order to provide that the space between the anode 4 and the cathode 6 is sufficiently deionized to prevent a subsequent voltage pulse from immediately resulting in an electric flashover again.

In order to be able to keep the deionization period 92 as short as possible, in one embodiment, the voltage pulse following the protection switching time 90 is generated by the control appliance 22 as a second voltage pulse 18 with a deionization amplitude 94 that is smaller than the operating amplitude 84. For this purpose, the control appliance forms the second voltage pulses 18 by applying a maximum of two of the three storage cells 46 to 50 to the magnetron 8 so that only two of the three cell voltages 40 to 44 also contribute to the accelerating voltage 10. If a certain number of these second voltage pulses 18 are output on the magnetron 8, without an electric flashover occurring, then the control appliance may apply the first voltage pulses 82 with the operating amplitude 84 again. Otherwise, if electric flashovers continue to occur in the aforementioned manner, then the control appliance 22 may further reduce the deionization amplitude 94 in the aforementioned manner.

The control appliance 22 may be set up to count the number of electric flashovers before the control appliance 22 generates the second voltage pulses 18 with the deionization amplitude instead of the first voltage pulses 14 with the operating amplitude 84. In addition, the control appliance 22 may be set up to reset a corresponding counter after a predetermined period free of flashovers.

Although the invention is illustrated and described in more detail by the exemplary embodiment, the invention is not restricted by the disclosed examples, and other variations may be derived from this by the person skilled in the art without departing from the scope of the invention.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims can, alternatively, be made to depend in the alternative from any preceding or following claim, whether independent or dependent, and that such new combinations are to be understood as forming a part of the present specification.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. A method for operating a device having an anode and a cathode for generating microwave radiation with an accelerating voltage, a chronological sequence of the accelerating voltage being provided by a sequence of voltage pulses, the method comprising:

applying a first voltage pulse with an operating amplitude between the anode and the cathode;

determining whether an electric flashover occurs during the applied first voltage pulse; and applying a second voltage pulse following the first voltage pulse with a deionization amplitude that is smaller than the operating amplitude when the electric flashover occurs during the applied first voltage pulse.

2. The method as claimed in claim 1, further comprising waiting a deionization period before the application of the second voltage pulse when the electric flashover occurs.

3. The method as claimed in claim 1, further comprising:

applying at least one additional first voltage pulse with the operating amplitude before the application of the second voltage pulse; and counting of the applied first voltage pulses between the anode and the cathode, in which the electric flashover occurs, wherein applying the second voltage pulse comprises applying the second voltage pulse when the number of applied first voltage pulses in which the flashover occurs exceeds a predetermined number.

4. The method as claimed in claim 3, further comprising resetting the number of applied first voltage pulses in which the electric flashover occurs when after a first voltage pulse in which the electric flashover occurred, a predetermined flashover-free period elapses.

5. The method as claimed in claim 1, further comprising:

determining whether an electric flashover occurs during the applied second voltage pulse;

reducing a deionization amplitude when the electric flashover occurs during the applied second voltage pulse; and applying the second voltage pulse with the reduced deionization amplitude between the anode and the cathode.

6. The method as claimed in claim 5, further comprising repeating the reduction of the deionization amplitude and the application of the second voltage pulse with the reduced deionization amplitude between the anode and the cathode when the electric flashover occurs during the applied second voltage pulse with the reduced deionization amplitude.

7. The method as claimed in claim 5, further comprising determining a fault when a value of the reduced deionization amplitude falls below a predetermined value.

8. The method as claimed in claim 1, further comprising generating the accelerating voltage with a multilevel converter connected between the anode and the cathode, and wherein the multilevel converter comprises a plurality of energy storage devices that are cascadable and are connectable in series between the anode and the cathode.

9. The method as claimed in claim 8, further comprising:

connecting, in series, a first group of the energy storage devices of the plurality of energy storage devices for the generation of the first voltage pulse; and connecting, in series, a second group of the energy storage devices of the plurality of energy storage devices for the generation of the second voltage pulse, wherein the number of the first group of energy storage devices is selected so as to be greater than the number of the second group of energy storage devices.

10. The method as claimed in claim 2, further comprising:

applying at least one additional first voltage pulse with the operating amplitude before the application of the second voltage pulse; and counting of the applied first voltage pulses between the anode and the cathode, in which the electric flashover occurs, wherein applying the second voltage pulse comprises applying the second voltage pulse when the number of applied first voltage pulses in which the flashover occurs exceeds a predetermined number.

11. The method as claimed in claim 10, further comprising resetting the number of applied first voltage pulses in which the electric flashover occurs when, after a first voltage pulse in which the electric flashover occurred, a predetermined flashover-free period elapses.

12. The method as claimed in claim 4, further comprising:

determining whether an electric flashover occurs during the applied second voltage pulse;

reducing a deionization amplitude when the electric flashover occurs during the applied second voltage pulse; and applying the second voltage pulse with the reduced deionization amplitude between the anode and the cathode.

13. The method as claimed in claim 12, further comprising repeating the reduction of the deionization amplitude and the application of the second voltage pulse with the reduced deionization amplitude between the anode and the cathode when the electric flashover occurs during the applied second voltage pulse with the reduced deionization amplitude.

14. The method as claimed in claim 6, further comprising determining a fault when a value of the reduced deionization amplitude falls below a predetermined value.

15. The method as claimed in claim 2, further comprising generating the accelerating voltage with a multilevel converter connected between the anode and the cathode, and wherein the multilevel converter comprises a plurality of energy storage devices that are cascadable and are connectable in series between the anode and the cathode.

16. An appliance for operating a device having an anode and a cathode for generating microwave radiation with an accelerating voltage, a chronological sequence of the accelerating voltage being provided by a sequence of voltage pulses, wherein the appliance is configured to:

apply a first voltage pulse with an operating amplitude between the anode and the cathode;

determine whether an electric flashover occurs during the applied first voltage pulse; and apply a second voltage pulse following the first voltage pulse with a deionization amplitude that is smaller than the operating amplitude when the electric flashover occurs during the applied first voltage pulse.

17. An arrangement comprising:

a device operable to generate microwave radiation, the device comprising an anode and a cathode; and an appliance operable to generate an accelerating voltage between the anode and the cathode, a chronological sequence of the accelerating voltage being provided by a sequence of voltage pulses, wherein the appliance is configured to:

apply a first voltage pulse with an operating amplitude between the anode and the cathode;

determine whether an electric flashover occurs during the applied first voltage pulse; and apply a second voltage pulse following the first voltage pulse with a deionization amplitude that is smaller than the operating amplitude when the electric flashover occurs during the applied first voltage pulse.

18. The arrangement as claimed in claim 17, further comprising a Marx modulator as a multilevel converter.

19. A therapy, fluoroscopic or irradiation device comprising:

an arrangement operable to generate microwave radiation, the arrangement comprising:

a device operable to generate the microwave radiation, the device comprising an anode and a cathode; and an appliance operable to generate an accelerating voltage between the anode and the cathode, a chronological sequence of the accelerating voltage being provided by a sequence of voltage pulses, wherein the appliance is configured to:

apply a first voltage pulse with an operating amplitude between the anode and the cathode;

determine whether an electric flashover occurs during the applied first voltage pulse; and apply a second voltage pulse following the first voltage pulse with a deionization amplitude that is smaller than the operating amplitude when the electric flashover occurs during the applied first voltage pulse.

20. The therapy, fluoroscopic or irradiation device as claimed in claim 19, further comprising a Marx modulator as a multilevel converter.

* * * * *